US008528138B2

(12) United States Patent
Hooper

(10) Patent No.: US 8,528,138 B2
(45) Date of Patent: Sep. 10, 2013

(54) COMPUTERIZED PILLOW-FITTING METHODS AND APPARATUSES

(75) Inventor: Mark Hooper, Wilson, NC (US)

(73) Assignee: My Ideal Pillow, Inc., Wilson, NC (US)

( * ) Notice: Subject to any disclaimer, the term of this patent is extended or adjusted under 35 U.S.C. 154(b) by 315 days.

(21) Appl. No.: 12/876,831

(22) Filed: Sep. 7, 2010

(65) Prior Publication Data

US 2010/0332009 A1 Dec. 30, 2010

Related U.S. Application Data

(63) Continuation-in-part of application No. 11/394,110, filed on Mar. 31, 2006, now abandoned.

(60) Provisional application No. 60/594,363, filed on Mar. 31, 2005.

(51) Int. Cl.
*A47C 20/00* (2006.01)

(52) U.S. Cl.
USPC ..... 5/636

(58) Field of Classification Search
USPC ..... 5/636–645; 700/97
See application file for complete search history.

(56) References Cited

U.S. PATENT DOCUMENTS

| | | | | |
|---|---|---|---|---|
| 6,585,328 | B1 * | 7/2003 | Oexman et al. | 700/117 |
| 2006/0236460 | A1 * | 10/2006 | Hooper | 5/636 |
| 2007/0021965 | A1 | 1/2007 | Boyd | |
| 2008/0244831 | A1 | 10/2008 | Kenmochi | |

OTHER PUBLICATIONS

Tempur-Pedic Pillows from www.Foamorder.com, Sep. 2004, http://web.archive.org/web/20040913202539/http://www.foamorder.com/tempur-pedic_3.html.
International Search Report dated Apr. 10, 2012 for PCT/US2011/050122.

* cited by examiner

*Primary Examiner* — Robert G Santos
*Assistant Examiner* — Richard G Davis
(74) *Attorney, Agent, or Firm* — Sughrue Mion, PLLC

(57) ABSTRACT

Computerized methods and apparatuses fit a pillow to an individual based on the characteristics of the individual. A computerized pillow-fitting apparatus has a processor, an input device configured to input a plurality of parameters corresponding to an individual's characteristics; a determination unit which uses the processor to determine, in response to the input of the plurality of parameters, a pillow identifier based on the plurality of parameters; and an output device configured to output the pillow identifier and configured to cause a pillow to be produced based on the pillow identifier.

18 Claims, 10 Drawing Sheets

COMPUTERIZED PILLOW-FITTING METHODS AND APPARATUSES

CROSS-REFERENCE TO RELATED APPLICATIONS

This application is a Continuation-In-Part application which claims priority to and the benefit of U.S. Non-Provisional patent application Ser. No. 11/394,110, filed on Mar. 31, 2006, which claims priority to U.S. Provisional Patent Application No. 60/594,363, filed on Mar. 31, 2005. The entire contents of each of the aforementioned applications are incorporated by reference in the present disclosure.

BACKGROUND

1. Technical Field

Illustrative embodiments relate generally to computerized pillow-fitting methods and apparatuses. More particularly, illustrative embodiments relate to computerized pillow-fitting apparatuses and methods that produce a pillow based on an individual's characteristics.

2. Description of the Related Art

An average person spends over 2,500 hours a year with his or her head on a pillow. Besides diet, sleep is an important factor for an individual's health and appearance. When the neck, head, and face have proper support and are not subjected to undue stress, an individual's health and appearance can benefit in many ways.

For example, a good night's sleep with a properly fitted pillow will help to decrease facial wrinkles due to proper neck and head support. Further, a properly fitted pillow decreases undue stress on the facial area and slows the aging process because proper sleep rejuvenates and repairs bodily organs and muscles, and helps reduce snoring by properly aligning the neck and pharynx, i.e., open the airway, to its maximum extent.

People customarily rest their heads on a pillow when sleeping on a mattress. Most individuals desire relaxing, enjoyable, refreshing, and undisturbed sleep. Pillows help accomplish these desires by providing proper support to necks and heads during sleep. Pillows can also provide a pleasant soft and cool sensation to the skin of an individual's neck and face, which also contributes to relaxing and undisturbed sleep.

People have very different body types and sleeping habits. Further, there are significant differences in height, weight, body type, age and other physical characteristics among different people.

People also have different preferred sleeping positions. For example, some people prefer to sleep on their backs, while others prefer sleeping on their stomachs or sides.

Pillows also have varying characteristics. For example, pillows have different sizes, shapes, densities, firmnesses, constructions, and materials. Therefore, different pillows best suit the varying sleeping needs of different people.

Significant problems arise when people do not use an appropriate pillow for sleep. A poorly constructed or worn out pillow can cause back, shoulder and neck pain. As a result, a person using the wrong pillow will have an unpleasant sleeping experience. The person may also be harmed by the lack of sleep and the unnatural or unhealthy position and support of the head and neck relative to the body for extended periods of time due to the improper pillow.

Unfortunately, most individuals are unable to determine the appropriate pillow because they are unaware of the different types of pillows and the various parameters that should influence their selection of a pillow. Further, despite having a similar appearance, one pillow may differ significantly from another pillow in the respective filling or thread count, for example, thus affecting the support that the pillow provides. Even if individuals are aware of the different types of pillows and the various parameters that should influence their selection of a pillow, such individuals may nevertheless fail to weigh the various parameters objectively, or their selection may be influenced by their subjective response to the pillow (e.g., how the pillow "feels" to the individual).

Therefore, a need exists to supply people with the proper pillow so that the proper sleeping experience can be achieved. A need also exists for an apparatus that objectively selects the proper pillow for individuals by weighing relevant parameters, including but not limited to the individual's physical characteristics and the structural characteristics of available pillows.

SUMMARY

Illustrative embodiments address these problems, and other problems not specifically mentioned above. Also, the present invention is not required to overcome the problems described above and an illustrative embodiment may not overcome any of the problems described above.

According to one illustrative embodiment, a computerized pillow-fitting method comprises: inputting, by a computer having a processor, a plurality of parameters corresponding to an individual's characteristics; determining, using the processor, a pillow identifier based on the plurality of parameters; outputting from the computer the pillow identifier; and producing a pillow based on the pillow identifier.

According to another illustrative embodiment, a computerized pillow-fitting method comprises: inputting, by a computer having a processor, a plurality of parameters corresponding to an individual's characteristics; determining, using the processor, a pillow identifier, based on the plurality of parameters by comparing values for each of the plurality of parameters with a database entry, wherein the database entry includes pillow identifier information corresponding to the values for each of the plurality of parameters; and producing a pillow based on the pillow identifier.

According to another illustrative embodiment, a computerized pillow-fitting apparatus, comprises: a processor; an input device configured to input a plurality of parameters corresponding to an individual's characteristics; a determination unit which uses the processor to determine, in response to the input of the plurality of parameters, a pillow identifier based on the plurality of parameters; an output device which outputs the pillow identifier and which causes a pillow to be produced based on the pillow identifier.

BRIEF DESCRIPTION OF THE DRAWINGS

Aspects of the present invention and its modes of operation will become more apparent by the following detailed description of illustrative embodiments with reference to the accompanying drawings in which like reference numerals correspond to like elements.

DETAILED DESCRIPTION

Illustrative embodiments of a computerized pillow-fitting apparatus and a computerized pillow-fitting method for determining and producing an appropriate pillow for an individual based on the characteristics of that individual will now be described. Pillows can be fitted, or can even be custom-designed, based on characteristics of the individual who will use the pillow. These characteristics can include, for example, sleeping position, height, weight, age, sex, posture, body type, chest size, neck size, head size, and a preferred pillow firmness. A custom-filled pillow can address the problems of disturbed, restless, and unpleasant sleep caused by pillows that do not properly suit the individual's body. In particular, such problems can be addressed by a pillow that is custom-fitted to the individual based on characteristics of the individual including, for example, the individual's sleeping preferences.

In certain illustrative embodiments, the construction of the pillow will vary in size and density from top to bottom. Further, according to an illustrative embodiment, an individual will be able to sleep on either side of the pillow enabling the individual to flip the pillow over and still be provided with the same support on the other side. In addition, according to an illustrative embodiment, some of the pillows will have varied density filling in outer and inner chambers depending on the individual's characteristics and primary sleeping position.

1. Computerized Apparatus

Figure 1:
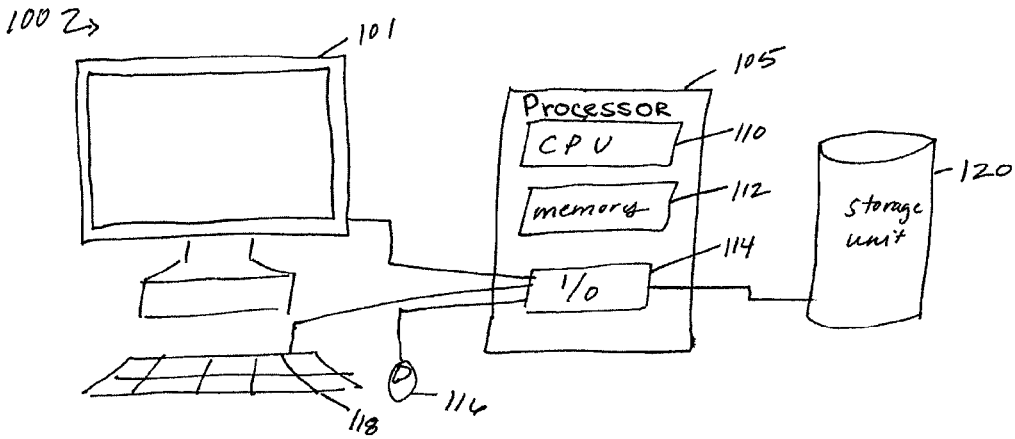
FIG. 1 illustrates a computerized pillow-fitting apparatus that uses a processor to determine a pillow identifier and ultimately produce a pillow according to an illustrative embodiment.

FIG. 1 illustrates the architecture of a computerized pillow-fitting apparatus implemented on a computer 100, according to one illustrative embodiment. The computer 100 comprises a processor 105 that includes a central processing unit (CPU) 110, a memory (e.g., RAM, ROM, etc.) 112 and an input/output (I/O) device 114. The processor 105 is connected through the I/O device 114 to a storage unit 120 and a display or monitor 101. The computer 100 further includes a keyboard 118 and mouse 116, connected to the I/O device 114, which allow an individual to input information. A computerized pillow-fitting apparatus program, which is a sequence of computer instructions, resides on the storage unit 120, is loaded into memory 112, and is executed by the CPU 110. The computerized pillow-fitting apparatus program further provides a graphical user interface (GUI) for interaction with the user on the monitor or display 101 of the computer 100.

2. Networked Apparatus

Figure 2:
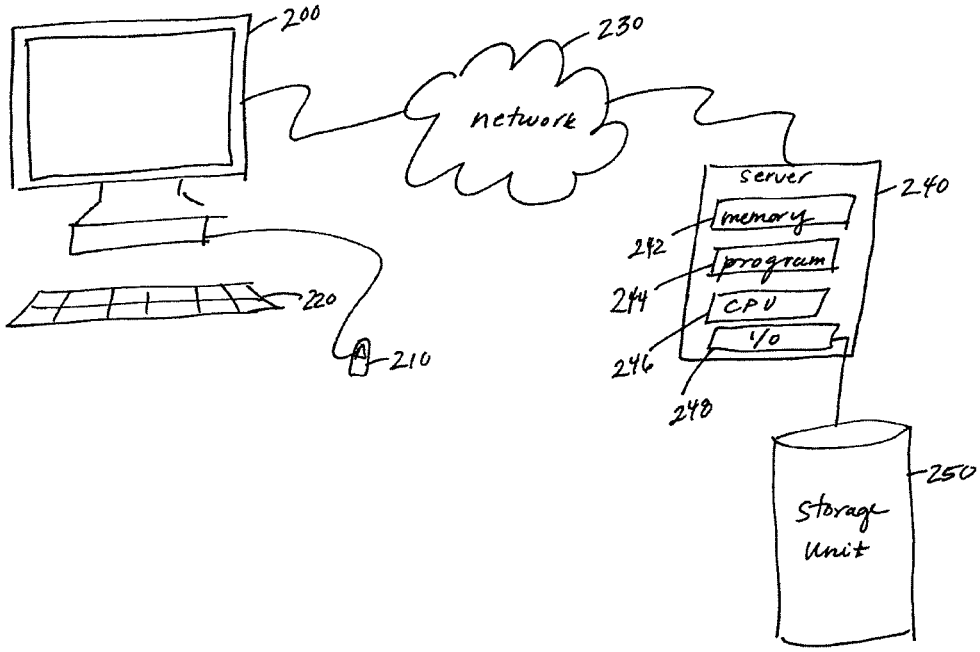
FIG. 2 illustrates a computerized pillow-fitting apparatus that uses a computer network according to an illustrative embodiment.

FIG. 2 illustrates an architecture of a computerized pillow-fitting apparatus implemented on a server 240 which communicates with a computer 200 via a network 230. The server 240 includes a CPU 246, a memory 242 and a pillow-fitting apparatus program 244. The server 240 is connected to a storage unit 250 which stores the back-end database that is accessed by the pillow-fitting apparatus program 244. The executed pillow-fitting apparatus program 244 displays a GUI on the display 200 so that a user can provide inputs to the apparatus.

3. Sleeping Positions

Figure 3:
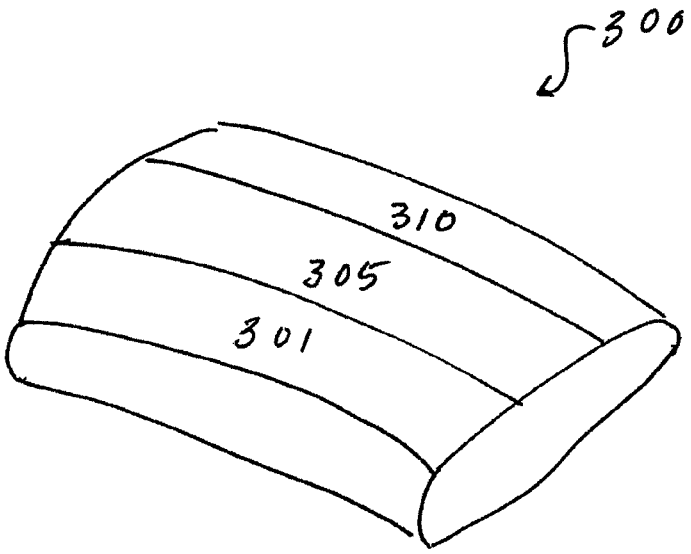
FIG. 3 illustrates a back sleeper pillow according to an illustrative embodiment.
Figure 4:
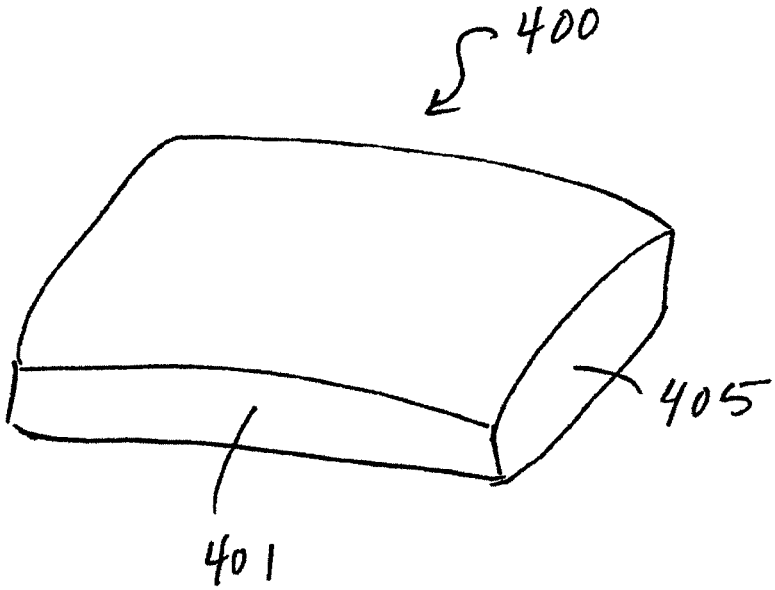
FIG. 4 illustrates a side sleeper pillow according to an illustrative embodiment.
Figure 5:
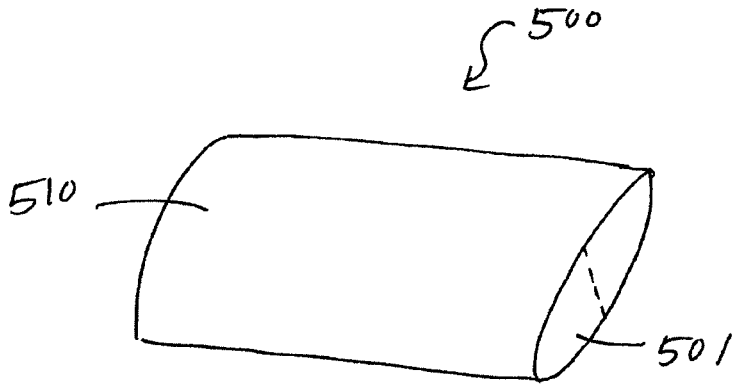
FIG. 5 illustrates a stomach sleeper pillow according to an illustrative embodiment.

There are several distinctive pillow designs with varied densities to fit an individual's characteristics and sleeping patterns. Three examples of types of pillows include, but are not limited to, the back sleeper 300, side sleeper 400, and stomach sleeper 500 as illustrated in FIGS. 3, 4, and 5, respectively. Each will be discussed below.

Back Sleeper—The back sleeper pillow type 300 is mainly prescribed to individuals who sleep on their backs. The back sleeper pillow type 300 has a varied density tri-chamber design 301, 305, 310 as illustrated in FIG. 3. The subtle but firm outer chambers properly support the neck and the soft center chamber cradles the individual's head.

Side Sleeper—The side sleeper pillow type 400 is mainly prescribed to individuals who sleep on their sides. The side sleeper pillow type 400 is surrounded with a two-inch baffle 401, 405 and has varied internal density as illustrated in FIG. 4. This design provides appropriate neck alignment and an even sleep surface.

Stomach Sleeper—The stomach sleep pillow type 500 is mainly prescribed to individuals who sleep on their stomachs. The stomach sleep pillow type 500 has a varied density tapered baffle end 501 for a gentle sloping sleep surface 510 as illustrated in FIG. 5.

These types of pillow merely are examples of the types of pillows that can be recommended and provided by the apparatuses and methods described herein.

4. Parameters for Pillow Selection

The computerized pillow-fitting apparatus selects a pillow based on the characteristics of an individual. According to an illustrative embodiment, each of these characteristics may be represented by a parameter, as discussed below.

A. Primary Parameters

GENDER—The values for the gender parameter include male or female. This parameter is of importance because, statistically, females have smaller frames, thinner necks and arms, and a lighter head mass when compared to males. Therefore, these considerations are accounted for by illustrative computerized pillow-fitting apparatuses and methods. Gender is an equally weighted parameter in all sleep positions.

AGE—Age is a parameter primarily used to customize pillows for the back sleeping position focusing on the need to support the curvature (lordosis) of the cervical spine. As the body ages, there is a general loss in bone density leading to more curvature in the spine which requires increased neck support. In contrast, individuals of the ages 3-15, for example, require less support due the development of the head and cervical spine and its lordosis.

HEIGHT—A direct correlation exists between height and neck length. The height parameter is of greater importance in the determinations for the back sleeper position.

WEIGHT—Men and women proportionately distribute weight differently, thus needing varying support from a pillow. Therefore, the weight parameter allows for consideration of weight. Weight is an equally weighted parameter in all sleep positions.

HEAD SIZE—Head size varies with the height and weight of the individual. Head size is an equally weighted parameter in all sleep positions.

POSTURE—Posture can affect the need for more or less pillow support. The posture parameter is particularly important in the determinations for back and stomach sleepers, but not as important in the determinations for the side sleeper.

CHEST SIZE—Chest size can affect the need for more or less pillow support depending on an individual's sleeping position. The chest size parameter is particularly important in the determinations for side and stomach sleepers, but not as important in the determinations for a back sleeper.

CUP SIZE—A female's cup size can affect the need for more or less pillow support depending on an individual's sleeping position. The cup size parameter may be considered only if the individual is a female.

MATTRESS—Density of the mattress affects the density of pillow needed. For example, a firm mattress would require more pillow support if an individual sleeps on their side because the individual's chest or shoulder are not absorbed into the mattress as much as with a soft mattress, thus a thicker pillow between the head and mattress is needed. The mattress density is an important determinate in selecting an appropriate pillow for all sleep positions.

SLEEPING POSITION—The values for the sleeping position parameter include back, side, and stomach. The sleeping position parameter represents the position in which an individual primarily falls asleep or the position in which the individual primarily sleeps. The sleeping position parameter is of importance because it determines the needed shape and infrastructure of the pillow.

According to an illustrative embodiment, pillows are classified by sleeping position, which includes side sleepers, stomach sleepers, and back sleepers. Some of the primary parameters for determining the proper pillow corresponding to each of the parameters will be discussed below.

According to an illustrative embodiment, when an individual specifies that he/she is a side sleeper, the computerized pillow-fitting apparatus will consider the gender, height, weight, head size, and mattress. According to an illustrative embodiment, if the individual is male, then chest size may be considered. If the individual is female, then chest size may not be considered.

If an individual specifies that they are a stomach sleeper, the pillow-fitting apparatus will consider the gender, weight, head size, mattress, and chest size.

As for the individual that specifies that they are a back sleeper, the pillow-fitting apparatus will consider gender, age, height, weight, head size, mattress, and posture.

According to an illustrative embodiment, measurements of actual persons, physical anthropology or somatology may be employed to determine values for various parameters. For example, it can be determined that a 5' 6" males typically exhibit certain corresponding parameters (e.g., head size, neck size, arm size, chest size, etc.) and, thus, correlating parameters for a 6' 2" can be determined.

B. Miscellaneous Other Parameters

PILLOW COVER—The pillow cover parameter corresponds to the fabric which covers a pillow. According to one illustrative embodiment, a hypoallergenic Primaloft or Down filling can be used with a 300 plus thread count cover. Such a covering for a pillow can provide the needed head and neck support while also allowing the material to breathe and provide a cool and gentle sensation to the face and head.

In one illustrative embodiment, pillows are covered with 312-thread count combed cotton sateen which allows the pillow to breathe while providing a cool and gentle sensation to the face and neck region. This parameter may change as appropriate depending on the individual's characteristics and preferences.

SIDE SLEEPERS—Further, there are miscellaneous parameters that mainly relate to side sleepers. For example, the side sleepers parameter may relate to the specific body position of the individual as they sleep on their side. The reason for these miscellaneous parameters for side sleepers is because side sleepers make up 70% of the consumers of pillows.

SOFT OR FIRM PILLOW—This parameter represents the different materials for filling a pillow depending on an individual's preference for a soft or a firm pillow. In particular, this parameter can represent specific materials for filling a pillow for an individual who sleeps on their side and has preferences for a soft or a firm pillow.

ARM UNDER THE PILLOW—Side sleepers or side/stomach sleepers generally sleep with their arm under the pillow. Such placement of the arm adds to the density present thus requiring less filling in the pillow. The arm under the pillow parameter accounts for the difference.

MULTI-POSITIONAL SLEEPERS—In addition, there is a parameter for representing multi-positional sleepers. These individuals have a primary position in which they fall asleep, and then switch to a secondary sleeping position. For example, an individual may start sleeping on their side and transition to their back, start on their back then to shift to their side, or start on their stomach then move to their side.

There are illustrative embodiments which account for those sleepers who have a primary position, then change positions from the primary position. For, example, in an illustrative embodiment, if the individual specifics that they are a side to stomach sleeper, then the computerized pillow-fitting apparatus will consider the gender, weight, head size, mattress, and chest size of the individual. If the individual is a side to stomach sleeper who also places their arm under the pillow, then the computerized pillow-fitting system will consider the gender, weight, head size, mattress, and chest of the individual. If the individual is only a side sleeper, but indicates that they sleep with their arm under the pillow, then the computerized pillow-fitting system will consider the gender, weight, head size, and mattress, with the addition of the chest size for men.

The foregoing parameters are merely examples of parameters that can be used in illustrative embodiments and are not to be constructed as limiting the present invention. For instance, in an illustrative embodiment, only a few of the available parameters may be used to determine the appropriate pillow. In another illustrative embodiment, all of the available parameters may be used to determine the appropriate pillow.

5. Selecting a Pillow

Figure 6:
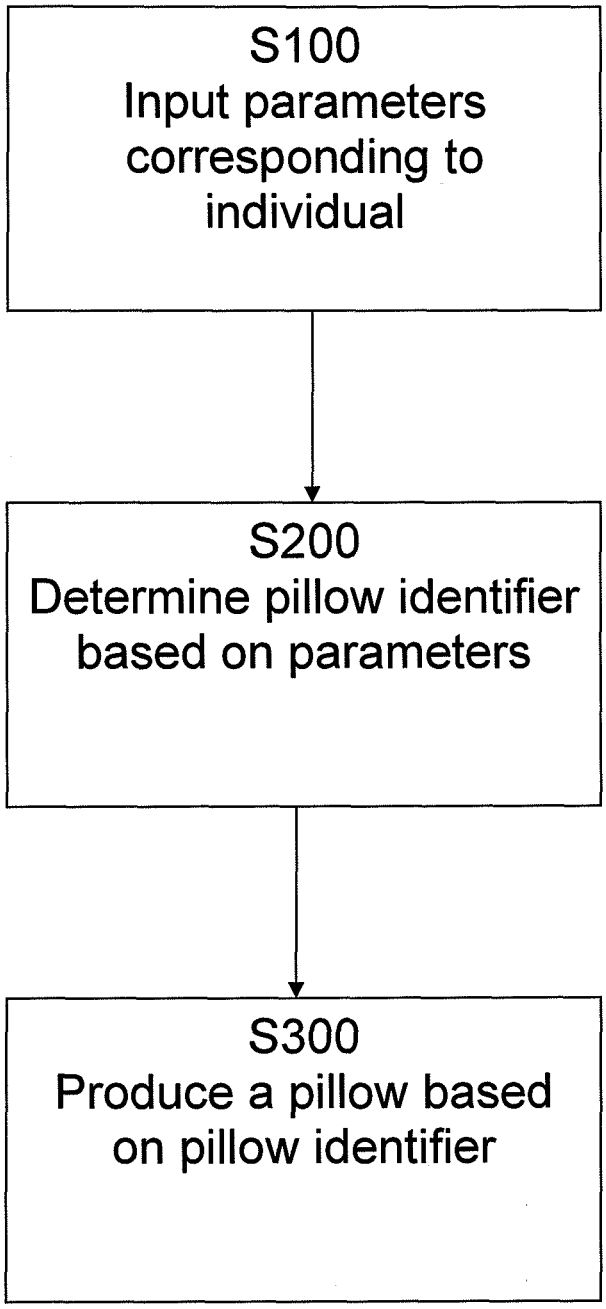
FIG. 6 illustrates a process for producing a custom-fitted pillow using the computerized pillow-fitting apparatus according to an illustrative embodiment.

In another illustrative embodiment, referring to FIG. 6, an individual inputs their characteristics into the computer (S100). Then, the computerized pillow-fitting apparatus will determine a pillow identifier based on the parameters corresponding to the characteristics inputted into the apparatus (S200). The pillow identifier may comprise, for example, a pillow number or a pillow code which, for example, is comprised of numbers and letters. The pillow identifier corresponds to a pillow with particular features fitted to the individual. A pillow is then produced based on the determined pillow identifier (S300). Producing a pillow can include, but is not limited to, retrieving the pillow from a warehouse or storeroom, manufacturing the pillow, or directly delivering the pillow to the individual customer.

Figure 7:
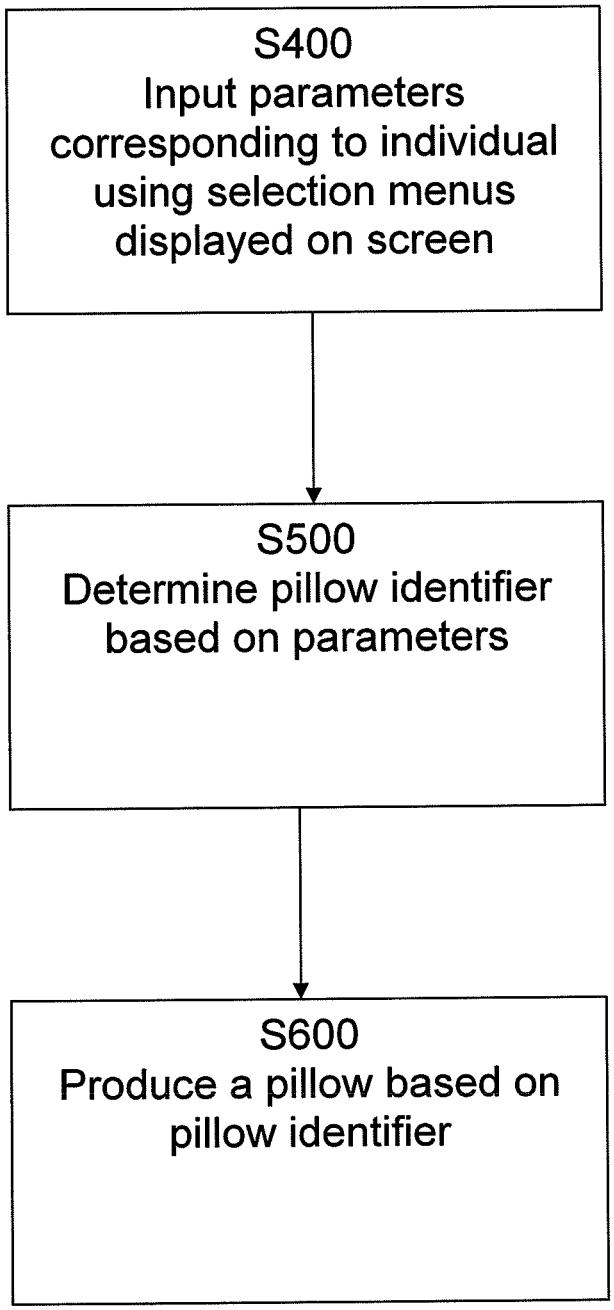
FIG. 7 illustrates a process for producing a custom-fitted pillow using the computerized pillow-fitting apparatus according to an illustrative embodiment.
Figure 8:
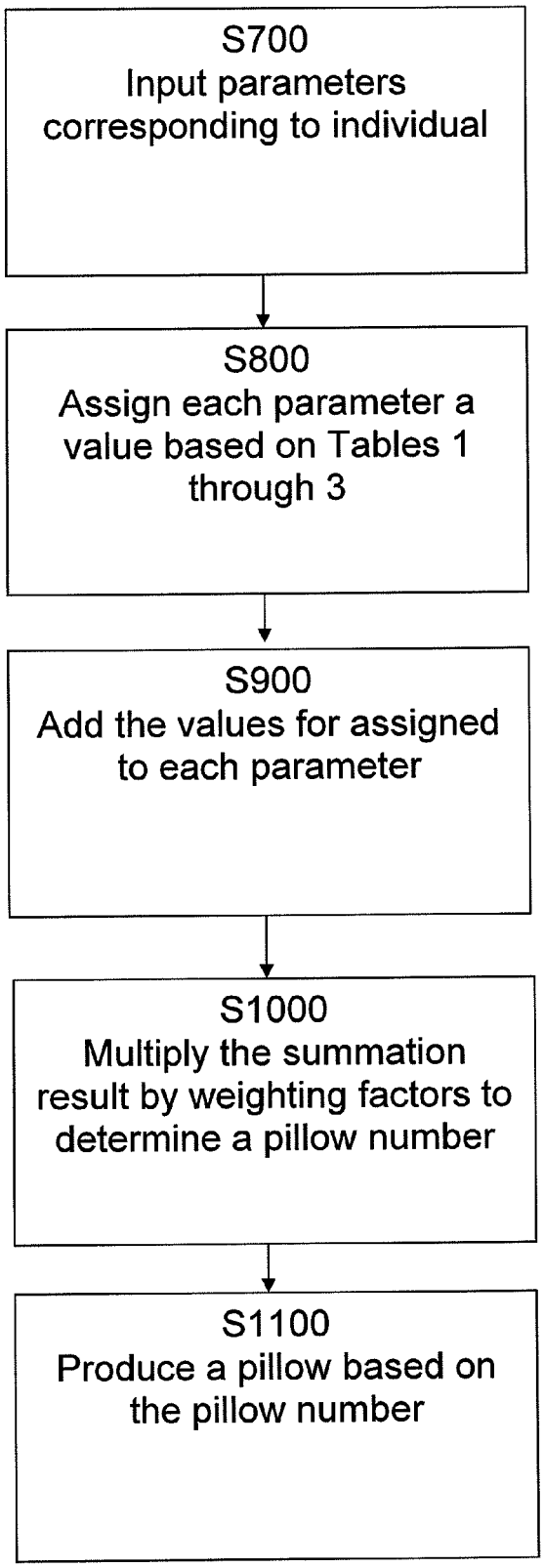
FIG. 8 illustrates a process for producing a custom-fitted pillow using the computerized pillow-fitting apparatus according to an illustrative embodiment.
Figure 9A:
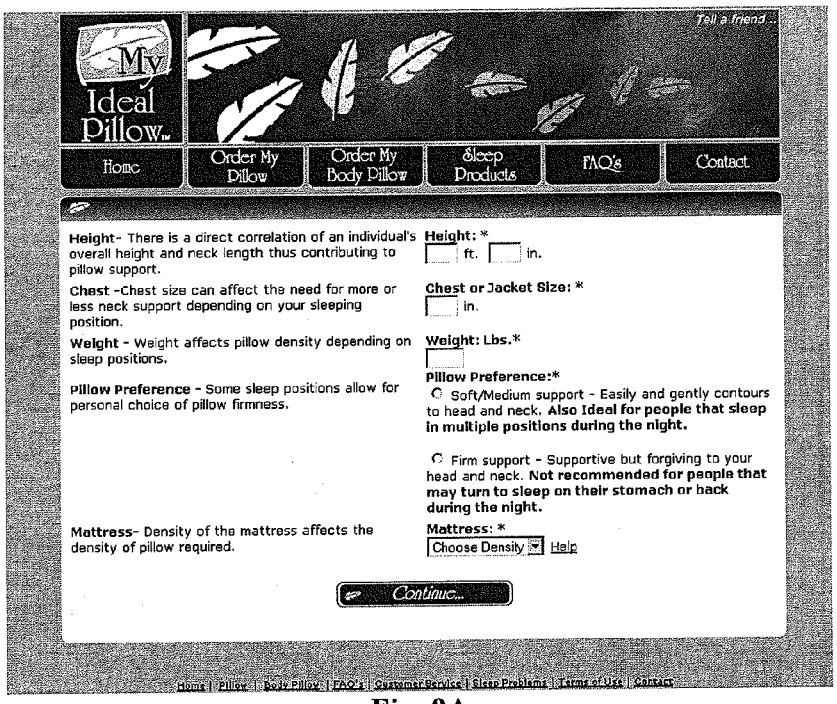
FIGS. 9A and 9B illustrate screen displays of the computerized pillow-fitting apparatus according to an illustrative embodiment.
Figure 9B:
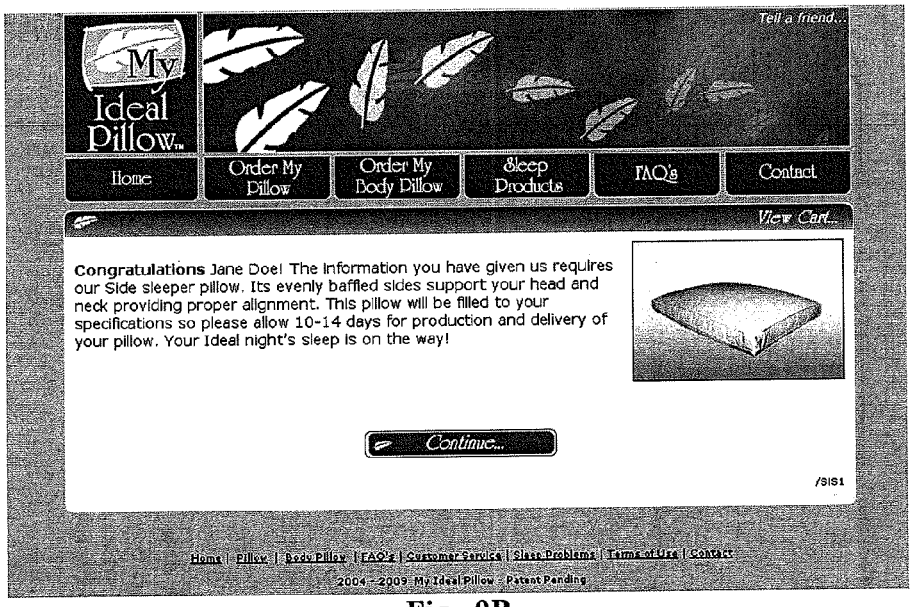

In another illustrative embodiment, referring to FIG. 7, a user enters their characteristics using a mouse, keyboard, touch screen, or similar device from selection menus displayed on the screen of a computer (S400). Such characteristics may include the user's physical characteristics. An example display screen is illustrated in FIG. 9A. Then the user will input their mattress density and sleeping position from selection menus such as those illustrated in FIG. 9A (S400). This data is then provided to the computerized pillow-fitting apparatus executed by the computer as illustrated in FIG. 1 or by a server as illustrated in FIG. 2, which will then determine a pillow identifier that corresponds to a particular pillow based on the information input by the user (S500). The calculation of a pillow identifier will be discussed below. The pillow corresponding to the determined pillow identifier is then displayed on the screen as illustrated in FIG. 9B. Based on the pillow identifier, the pillow can be manufactured, selected from a warehouse, or picked up by the user (S600).

In another illustrative embodiment, once the parameters are entered (S700), the apparatus will assign each parameter a value based on values like those shown in Table 1 through Table 3 shown below (S800). These tables can be stored in storage unit, for example. By way of illustration, if the individual enters "14 years-old" for age, then the processor of the computer will access Table 1, find an age range corresponding to the entered age and find the corresponding value, "0." If an individual enters "female" for gender, then the processor will access the Table 1, find the entered "female" gender and find the corresponding value, "−1." The values set forth in Tables 1-3 are merely examples and a wide range of values can be assigned to each parameter consistent with illustrative embodiments.

Once each of the parameters are assigned a value, the values are summed (S900). The summation result is then multiplied by appropriate weighting factor(s). For example, a weighting factor may be assigned corresponding to the sleeping position that the individual provided to the apparatus (S1000). Such a weighting factor corresponding to the sleeping position is assigned based on the overall importance of sleeping position component relative to the pillow being produced.

According to one illustrative embodiment, the weighting factor corresponding to the sleeping position is assigned a value of 50% whereas the remaining entered parameters are assigned a weighting factor of 50%. However, the present invention is not limited to such an illustrative embodiment. For instance, a wide range of values can be assigned as weighting factors corresponding to each of the parameters based on their respective overall importance.

The number resulting from the product of the summation result and the weighting factor(s) is referred to as the pillow number, which is one example of a pillow identifier that corresponds to a pillow. Based on the pillow number, the pillow can be manufactured, selected from a warehouse, or picked up by the user (S1100).

TABLE 1

| | Parameter Input Range | Parameter Value |
|---|---|---|
| 1. AGE | 5 to 10 years | −2 |
| | 13 to 21 years | 0 |
| | 22 to 50 | +1 |
| | 51 and up | +2 |

TABLE 1-continued

| | Parameter Input Range | Parameter Value |
|---|---|---|
| 2. HEIGHT | 3 ft. to 5 ft. | −2 |
| | 5 ft. to 6 ft. | 0 |
| | 6 ft. to 6 ft., 6 in. | +1 |
| | 6 ft., 6 in. to 7 ft., 6 in. | +4 |
| 3. WEIGHT | 40 lbs. to 100 lbs. | −2 |
| | 101 to 180 | 0 |
| | 181 to 225 | +2 |
| | 226 to 300 | +3 |
| | 301 to 400 | +4 |
| 4. HEAD SIZE | X-small | +2 |
| | Small | +3 |
| | Average | 0 |
| | Above Average | −1 |
| | Large | −2 |
| 5. POSTURE | Head held back | −2 |
| | Normal | 0 |
| | Head held forward | +2 |
| 6. GENDER | Male | 0 |
| | Female | −1 |

TABLE 2

| MALE | Parameter Value |
|---|---|
| 20 to 36 in. | −2 |
| 37 to 42 in. | 0 |
| 43 to 50 in. | +2 |
| 51 to 60 in. | +4 |

TABLE 3

| FEMALE (32-42 inches) | Parameter Value |
|---|---|
| A to B Cup size | 0 |
| C to D Cup size | +2 |
| E and up | +4 |

In another illustrative embodiment, instead of assigning a value to each parameter, and calculating a pillow number as a pillow identifier, the computerized pillow-fitting apparatus will use the input parameters provided by the individual to determine a pillow code. A pillow code is another example of a pillow identifier. Then, the values are compared with tables stored on a storage unit like that shown in FIGS. 1 and 2.

Tables 4 through 9 provide example tables utilized by the computerized pillow-fitting apparatus. Table 4 corresponds to a back sleeper. Table 5 corresponds to a side sleeper. Table 6 corresponds to a female stomach sleeper with a cup size ranging between an A and C cup. Table 7 corresponds to a female stomach sleeper with a cup size with a D cup or larger. Table 8 corresponds to a male stomach sleeper.

Each table contains values for relevant parameters and corresponding pillow codes. Based on the table entries, the apparatus will provide a pillow code by displaying it on the display. Alternatively, the pillow code can be printed on a printer. The pillow code can also be provided to a sales clerk who can use the pillow code to retrieve the corresponding pillow from a storage area of a store, or can be provided to a manufacturer who can construct the appropriate pillow.

TABLE 4

Table 4 contains pillow codes for an individual who sleeps on his or her back. Table 4 includes the characteristics of height, chest size, and weight. Table 4 applies to males and females.

| Height | Chest | Weight | Pillow Code |
|---|---|---|---|
| 0-5'3" | 0-34 | <130 | BS1 |
| 0-5'3" | 0-34 | >130 | BS1 |
| 0-5'3" | 34-40 | <150 | BS1 |
| 0-5'3" | 34-40 | >150 | BS2 |
| 0-5'3" | 40-46 | <200 | BS2 |
| 0-5'3" | 40-46 | >200 | BS2 |
| 0-5'3" | 46> | <225 | BS3 |
| 0-5'3" | 46> | >225 | BS3 |
| 5'3"-5'6" | 0-34 | <150 | BS1 |
| 5'3"-5'6" | 0-34 | >150 | BS2 |
| 5'3"-5'6" | 34-40 | <170 | BS2 |
| 5'3"-5'6" | 34-40 | >170 | BS2 |
| 5'3"-5'6" | 40-46 | <210 | BS2 |
| 5'3"-5'6" | 40-46 | >210 | BS3 |
| 5'3"-5'6" | 46-50 | <230 | BS2 |
| 5'3"-5'6" | 46-50 | >230 | BS3 |
| 5'3"-5'6" | 50> | <250 | BS3 |
| 5'3"-5'6" | 50> | >250 | BS3 |
| 5'6"-5'9" | 0-35 | <160 | BS2 |
| 5'6"-5'9" | 0-35 | >160 | BS2 |
| 5'6"-5'9" | 35-40 | <185 | BS2 |
| 5'6"-5'9" | 35-40 | >185 | BS3 |
| 5'6"-5'9" | 40-46 | <225 | BS3 |
| 5'6"-5'9" | 40-46 | >225 | BS3 |
| 5'6"-5'9" | 46-50 | <245 | BS3 |
| 5'6"-5'9" | 46-50 | >245 | BS4 |
| 5'6"-5'9" | 50> | <265 | BS4 |
| 5'6"-5'9" | 50> | >265 | BS4 |
| 5'9"-6'2" | 0-36 | <170 | BS2 |
| 5'9"-6'2" | 0-36 | >170 | BS3 |
| 5'9"-6'2" | 36-40 | <200 | BS3 |
| 5'9"-6'2" | 36-40 | >200 | BS3 |
| 5'9"-6'2" | 40-46 | <240 | BS3 |
| 5'9"-6'2" | 40-46 | >240 | BS4 |
| 5'9"-6'2" | 46-50 | <265 | BS3 |
| 5'9"-6'2" | 46-50 | >265 | BS4 |
| 5'9"-6'2" | 50> | <275 | BS4 |
| 5'9"-6'2" | 50> | >275 | BS4 |
| 6'2"-higher | 0-36 | <180 | BS2 |
| 6'2"-higher | 0-36 | >180 | BS3 |
| 6'2"-higher | 36-40 | <220 | BS3 |
| 6'2"-higher | 36-40 | >220 | BS4 |
| 6'2"-higher | 40-46 | <245 | BS4 |
| 6'2"-higher | 40-46 | >245 | BS4 |
| 6'2"-higher | 46-50 | <260 | BS4 |
| 6'2"-higher | 46-50 | >260 | BS4 |
| 6'2"-higher | 50> | <285 | BS4 |
| 6'2"-higher | 50> | >285 | BS4 |

TABLE 5

Table 5 contains pillow codes for an individual who sleeps on his or her side. Table 5 includes the characteristics of height, chest size, weight, and preferred pillow firmness. Table 5 applies to males and females.

| Height | Chest | Weight | Pillow Code - Firm | Pillow Code - Soft |
|---|---|---|---|---|
| 0-5'3" | 0-34 | <130 | SiSf1 | SiS1 |
| 0-5'3" | 0-34 | >130 | SiSf1 | SiS1 |
| 0-5'3" | 34-40 | <150 | SiSf1 | SiS1 |
| 0-5'3" | 34-40 | >150 | SiSf1 | SiS2 |
| 0-5'3" | 40-46 | <200 | SiSf2 | SiS3 |
| 0-5'3" | 40-46 | >200 | SiSf2 | SiS4 |
| 0-5'3" | 46> | <225 | SiSf3 | SiS4 |
| 0-5'3" | 46> | >225 | SiSf3 | SiS4 |
| 5'3"-5'6" | 0-34 | <150 | SiSf1 | SiS1 |
| 5'3"-5'6" | 0-34 | >150 | SiSf1 | SiS2 |
| 5'3"-5'6" | 34-40 | <170 | SiSf1 | SiS2 |
| 5'3"-5'6" | 34-40 | >170 | SiSf2 | SiS3 |

TABLE 5-continued

Table 5 contains pillow codes for an individual who sleeps on his or her side. Table 5 includes the characteristics of height, chest size, weight, and preferred pillow firmness. Table 5 applies to males and females.

| Height | Chest | Weight | Pillow Code - Firm | Pillow Code - Soft |
|---|---|---|---|---|
| 5'3"-5'6" | 40-46 | <210 | SiSf2 | SiS3 |
| 5'3"-5'6" | 40-46 | >210 | SiSf3 | SiS4 |
| 5'3"-5'6" | 46-50 | <230 | SiSf2 | SiS4 |
| 5'3"-5'6" | 46-50 | >230 | SiSf3 | SiS4 |
| 5'3"-5'6" | 50> | <250 | SiSf3 | SiS4 |
| 5'3"-5'6" | 50> | >250 | SiSf3 | SiS5 |
| 5'6"-5'9" | 0-35 | <160 | SiSf1 | SiS2 |
| 5'6"-5'9" | 0-35 | >160 | SiSf1 | SiS2 |
| 5'6"-5'9" | 35-40 | <185 | SiSf1 | SiS2 |
| 5'6"-5'9" | 35-40 | >185 | SiSf2 | SiS3 |
| 5'6"-5'9" | 40-46 | <225 | SiSf2 | SiS3 |
| 5'6"-5'9" | 40-46 | >225 | SiSf3 | SiS4 |
| 5'6"-5'9" | 46-50 | <245 | SiSf3 | SiS4 |
| 5'6"-5'9" | 46-50 | >245 | SiSf3 | SiS4 |
| 5'6"-5'9" | 50> | <265 | SiSf3 | SiS5 |
| 5'6"-5'9" | 50> | >265 | SiSf4 | SiS5 |
| 5'9"-6'2" | 0-36 | <170 | SiSf1 | SiS2 |
| 5'9"-6'2" | 0-36 | >170 | SiSf2 | SiS3 |
| 5'9"-6'2" | 36-40 | <200 | SiSf2 | SiS3 |
| 5'9"-6'2" | 36-40 | >200 | SiSf2 | SiS3 |
| 5'9"-6'2" | 40-46 | <240 | SiSf2 | SiS3 |
| 5'9"-6'2" | 40-46 | >240 | SiSf3 | SiS4 |
| 5'9"-6'2" | 46-50 | <265 | SiSf3 | SiS4 |
| 5'9"-6'2" | 46-50 | >265 | SiSf4 | SiS5 |
| 5'9"-6'2" | 50> | <275 | SiSf3 | SiS4 |
| 5'9"-6'2" | 50> | >275 | SiSf4 | SiS5 |
| 6'2"-higher | 0-36 | <180 | SiSf1 | SiS2 |
| 6'2"-higher | 0-36 | >180 | SiSf2 | SiS3 |
| 6'2"-higher | 36-40 | <220 | SiSf3 | SiS3 |
| 6'2"-higher | 36-40 | >220 | SiSf3 | SiS4 |
| 6'2"-higher | 40-46 | <245 | SiSf3 | SiS4 |
| 6'2"-higher | 40-46 | >245 | SiSf4 | SiS4 |
| 6'2"-higher | 46-50 | <260 | SiSf4 | SiS4 |
| 6'2"-higher | 46-50 | >260 | SiSf4 | SiS5 |
| 6'2"-higher | 50> | <285 | SiSf4 | SiS5 |
| 6'2"-higher | 50> | >285 | SiSf4 | SiS6 |

TABLE 6

Table 6 contains pillow codes for a female who sleeps on her stomach with a cup size ranging from an A to C cup. Table 6 includes the characteristics of height, chest size in inches, cup size, and weight.

| Height | Chest | A-C Cup | Weight | Pillow Code |
|---|---|---|---|---|
| 0-5'3" | 0-34 | yes | <130 | StS1 |
| 0-5'3" | 0-34 | yes | >130 | StS1 |
| 0-5'3" | 34-40 | yes | <150 | StS1 |
| 0-5'3" | 34-40 | yes | >150 | StS2 |
| 0-5'3" | 40-46 | yes | <200 | StS2 |
| 0-5'3" | 40-46 | yes | >200 | StS3 |
| 0-5'3" | 46> | yes | <225 | StS2 |
| 0-5'3" | 46> | yes | >225 | StS3 |
| 5'3"-5'6" | 0-34 | yes | <150 | StS1 |
| 5'3"-5'6" | 0-34 | yes | >150 | StS2 |
| 5'3"-5'6" | 34-40 | yes | <170 | StS1 |
| 5'3"-5'6" | 34-40 | yes | >170 | StS2 |
| 5'3"-5'6" | 40-46 | yes | <210 | StS2 |
| 5'3"-5'6" | 40-46 | yes | >210 | StS3 |
| 5'3"-5'6" | 46-50 | yes | <230 | StS3 |
| 5'3"-5'6" | 46-50 | yes | >230 | StS4 |
| 5'3"-5'6" | 50> | yes | <250 | StS3 |
| 5'3"-5'6" | 50> | yes | >250 | StS4 |
| 5'6"-5'9" | 0-35 | yes | <160 | StS1 |
| 5'6"-5'9" | 0-35 | yes | >160 | StS2 |
| 5'6"-5'9" | 35-40 | yes | <185 | StS2 |
| 5'6"-5'9" | 35-40 | yes | >185 | StS3 |

TABLE 6-continued

Table 6 contains pillow codes for a female who sleeps on her stomach with a cup size ranging from an A to C cup. Table 6 includes the characteristics of height, chest size in inches, cup size, and weight.

| Height | Chest | A-C Cup | Weight | Pillow Code |
|---|---|---|---|---|
| 5'6"-5'9" | 40-46 | yes | <225 | StS2 |
| 5'6"-5'9" | 40-46 | yes | >225 | StS3 |
| 5'6"-5'9" | 46-50 | yes | <245 | StS3 |
| 5'6"-5'9" | 46-50 | yes | >245 | StS4 |
| 5'6"-5'9" | 50> | yes | <265 | StS3 |
| 5'6"-5'9" | 50> | yes | >265 | StS4 |
| 5'9"-6'2" | 0-36 | yes | <170 | StS1 |
| 5'9"-6'2" | 0-36 | yes | >170 | StS2 |
| 5'9"-6'2" | 36-40 | yes | <200 | StS2 |
| 5'9"-6'2" | 36-40 | yes | >200 | StS3 |
| 5'9"-6'2" | 40-46 | yes | <240 | StS3 |
| 5'9"-6'2" | 40-46 | yes | >240 | StS4 |
| 5'9"-6'2" | 46-50 | yes | <265 | StS3 |
| 5'9"-6'2" | 46-50 | yes | >265 | StS4 |
| 5'9"-6'2" | 50> | yes | <275 | StS4 |
| 5'9"-6'2" | 50> | yes | >275 | StS4 |
| 6'2"-higher | 0-36 | yes | <180 | StS2 |
| 6'2"-higher | 0-36 | yes | >180 | StS3 |
| 6'2"-higher | 36-40 | yes | <210 | StS3 |
| 6'2"-higher | 36-40 | yes | >210 | StS4 |
| 6'2"-higher | 40-46 | yes | <245 | StS3 |
| 6'2"-higher | 40-46 | yes | >245 | StS4 |
| 6'2"-higher | 46-50 | yes | <275 | StS4 |
| 6'2"-higher | 46-50 | yes | >275 | StS4 |
| 6'2"-higher | 50> | yes | <300 | StS4 |
| 6'2"-higher | 50> | yes | >300 | StS4 |

TABLE 7

Table 7 contains pillow codes for a female who sleeps on her stomach with a cup size of at least a D cup. Table 7 includes the characteristics of height, chest size in inches, cup size, and weight.

| Height | Chest | D Cup or larger | Weight | Pillow Code |
|---|---|---|---|---|
| 0-5'3" | 0-34 | yes | <130 | StS2 |
| 0-5'3" | 0-34 | yes | >130 | StS2 |
| 0-5'3" | 34-40 | yes | <150 | StS2 |
| 0-5'3" | 34-40 | yes | >150 | StS2 |
| 0-5'3" | 40-46 | yes | <200 | StS2 |
| 0-5'3" | 40-46 | yes | >200 | StS3 |
| 0-5'3" | 46> | yes | <225 | StS3 |
| 0-5'3" | 46> | yes | >225 | StS4 |
| 5'3"-5'6" | 0-34 | yes | <150 | StS2 |
| 5'3"-5'6" | 0-34 | yes | >150 | StS3 |
| 5'3"-5'6" | 34-40 | yes | <170 | StS2 |
| 5'3"-5'6" | 34-40 | yes | >170 | StS3 |
| 5'3"-5'6" | 40-46 | yes | <210 | StS3 |
| 5'3"-5'6" | 40-46 | yes | >210 | StS4 |
| 5'3"-5'6" | 46-50 | yes | <230 | StS4 |
| 5'3"-5'6" | 46-50 | yes | >230 | StS4 |
| 5'3"-5'6" | 50> | yes | <250 | StS4 |
| 5'3"-5'6" | 50> | yes | >250 | StS4 |
| 5'6"-5'9" | 0-35 | yes | <160 | StS2 |
| 5'6"-5'9" | 0-35 | yes | >160 | StS3 |
| 5'6"-5'9" | 35-40 | yes | <185 | StS3 |
| 5'6"-5'9" | 35-40 | yes | >185 | StS3 |
| 5'6"-5'9" | 40-46 | yes | <225 | StS3 |
| 5'6"-5'9" | 40-46 | yes | >225 | StS4 |
| 5'6"-5'9" | 46-50 | yes | <245 | StS4 |
| 5'6"-5'9" | 46-50 | yes | >245 | StS4 |
| 5'6"-5'9" | 50> | yes | <265 | StS4 |
| 5'6"-5'9" | 50> | yes | >265 | StS4 |
| 5'9"-6'2" | 0-36 | yes | <170 | StS2 |
| 5'9"-6'2" | 0-36 | yes | >170 | StS3 |
| 5'9"-6'2" | 36-40 | yes | <200 | StS3 |
| 5'9"-6'2" | 36-40 | yes | >200 | StS3 |
| 5'9"-6'2" | 40-46 | yes | <240 | StS3 |

TABLE 7-continued

Table 7 contains pillow codes for a female who sleeps on her stomach with a cup size of at least a D cup. Table 7 includes the characteristics of height, chest size in inches, cup size, and weight.

| Height | Chest | D Cup or larger | Weight | Pillow Code |
|---|---|---|---|---|
| 5'9"-6'2" | 40-46 | yes | >240 | StS4 |
| 5'9"-6'2" | 46-50 | yes | <265 | StS4 |
| 5'9"-6'2" | 46-50 | yes | >265 | StS4 |
| 5'9"-6'2" | 50> | yes | <275 | StS4 |
| 5'9"-6'2" | 50> | yes | >275 | StS4 |
| 6'2"-higher | 0-36 | yes | <180 | StS3 |
| 6'2"-higher | 0-36 | yes | >180 | StS4 |
| 6'2"-higher | 36-40 | yes | <210 | StS4 |
| 6'2"-higher | 36-40 | yes | >210 | StS4 |
| 6'2"-higher | 40-46 | yes | <245 | StS4 |
| 6'2"-higher | 40-46 | yes | >245 | StS4 |
| 6'2"-higher | 46-50 | yes | <275 | StS4 |
| 6'2"-higher | 46-50 | yes | >275 | StS4 |
| 6'2"-higher | 50> | yes | <300 | StS4 |
| 6'2"-higher | 50> | yes | >300 | StS4 |

TABLE 8

Table 8 contains pillow codes for a male who sleeps on his side. Table 8 includes the characteristics of height, chest size, and weight.

| Height | Chest | Weight | Pillow Code |
|---|---|---|---|
| 0-5'3" | 0-34 | <130 | StS1 |
| 0-5'3" | 0-34 | >130 | StS2 |
| 0-5'3" | 34-40 | <150 | StS1 |
| 0-5'3" | 34-40 | >150 | StS2 |
| 0-5'3" | 40-46 | <200 | StS2 |
| 0-5'3" | 40-46 | >200 | StS2 |
| 0-5'3" | 46> | <225 | StS2 |
| 0-5'3" | 46> | >225 | StS3 |
| 5'3"-5'6" | 0-34 | <150 | StS1 |
| 5'3"-5'6" | 0-34 | >150 | StS2 |
| 5'3"-5'6" | 34-40 | <170 | StS1 |
| 5'3"-5'6" | 34-40 | >170 | StS2 |
| 5'3"-5'6" | 40-46 | <210 | StS2 |
| 5'3"-5'6" | 40-46 | >210 | StS3 |
| 5'3"-5'6" | 46-50 | <230 | StS3 |
| 5'3"-5'6" | 46-50 | >230 | StS4 |
| 5'3"-5'6" | 50> | <250 | StS3 |
| 5'3"-5'6" | 50> | >250 | StS4 |
| 5'6"-5'9" | 0-35 | <160 | StSi |
| 5'6"-5'9" | 0-35 | >160 | StS2 |
| 5'6"-5'9" | 35-40 | <185 | StS2 |
| 5'6"-5'9" | 35-40 | >185 | StS3 |
| 5'6"-5'9" | 40-46 | <225 | StS2 |
| 5'6"-5'9" | 40-46 | >225 | StS3 |
| 5'6"-5'9" | 46-50 | <245 | StS3 |
| 5'6"-5'9" | 46-50 | >245 | StS4 |
| 5'6"-5'9" | 50> | <265 | StS4 |
| 5'6"-5'9" | 50> | >265 | StS4 |
| 5'9"-6'2" | 0-36 | <170 | StS1 |
| 5'9"-6'2" | 0-36 | >170 | StS2 |
| 5'9"-6'2" | 36-40 | <200 | StS2 |
| 5'9"-6'2" | 36-40 | >200 | StS3 |
| 5'9"-6'2" | 40-46 | <240 | StS3 |
| 5'9"-6'2" | 40-46 | >240 | StS3 |
| 5'9"-6'2" | 46-50 | <265 | StS3 |
| 5'9"-6'2" | 46-50 | >265 | StS4 |
| 5'9"-6'2" | 50> | <275 | StS4 |
| 5'9"-6'2" | 50> | >275 | StS4 |
| 6'2"-higher | 0-36 | <180 | StS2 |
| 6'2"-higher | 0-36 | >180 | StS3 |
| 6'2"-higher | 36-40 | <210 | StS3 |
| 6'2"-higher | 36-40 | >210 | StS4 |
| 6'2"-higher | 40-46 | <245 | StS3 |
| 6'2"-higher | 40-46 | >245 | StS4 |
| 6'2"-higher | 46-50 | <275 | StS4 |
| 6'2"-higher | 46-50 | >275 | StS4 |

TABLE 8-continued

Table 8 contains pillow codes for a male who sleeps on his side. Table 8 includes the characteristics of height, chest size, and weight.

| Height | Chest | Weight | Pillow Code |
|---|---|---|---|
| 6'2"-higher | 50> | <300 | StS4 |
| 6'2"-higher | 50> | >300 | StS4 |

TABLE 9

Table 9 provides the type of pillow that corresponds to the determined pillow code. In particular, Table 9 contains all of the pillow codes for the above tables and the corresponding fill weights and types of filler material.

| Back Sleepers | | | |
|---|---|---|---|
| Code | Brand | Ounces | Specifications |
| BS1 | Primaloft | 30 oz | 11 outer/8 inner |
| BS2 | Primaloft | 34 oz | 13 outer/8 inner |
| BS3 | Primaloft | 38 oz | 15 outer/8 inner |
| BS4 | Primaloft | 42 oz | 17 outer/8 inner |

| Side Sleepers - Soft/Medium | | |
|---|---|---|
| Code | Brand | Ounces |
| SiS1 | Primaloft | 26 oz |
| SiS2 | Lyocell | 20 oz |
| SiS3 | Lyocell | 22 oz |
| SiS4 | Lyocell | 24 oz |
| SiS5 | Lyocell | 26 oz |

| Side Sleepers-Firm | | |
|---|---|---|
| Code | Brand | Ounces |
| SiSf1 | Sensuelle | 23 oz |
| SiSf2 | Sensuelle | 26 oz |
| SiSf3 | Sensuelle | 29 oz |
| SiSf4 | Sensuelle | 31 oz |

| Stomach Sleepers - Soft/Medium | | |
|---|---|---|
| Code | Brand | Ounces |
| StS1 | Primaloft | 19 oz |
| StS2 | Lyocell | 17 oz |
| StS3 | Lyocell | 19 oz |
| StS4 | Lyocell | 21 oz |

6. Production of a Pillow

According to certain illustrative embodiments, based on the determined pillow identifier, a pillow can then be manufactured, retrieved form a warehouse, or directly provided to a customer.

A. Manufacturing a Pillow

Figure 10:
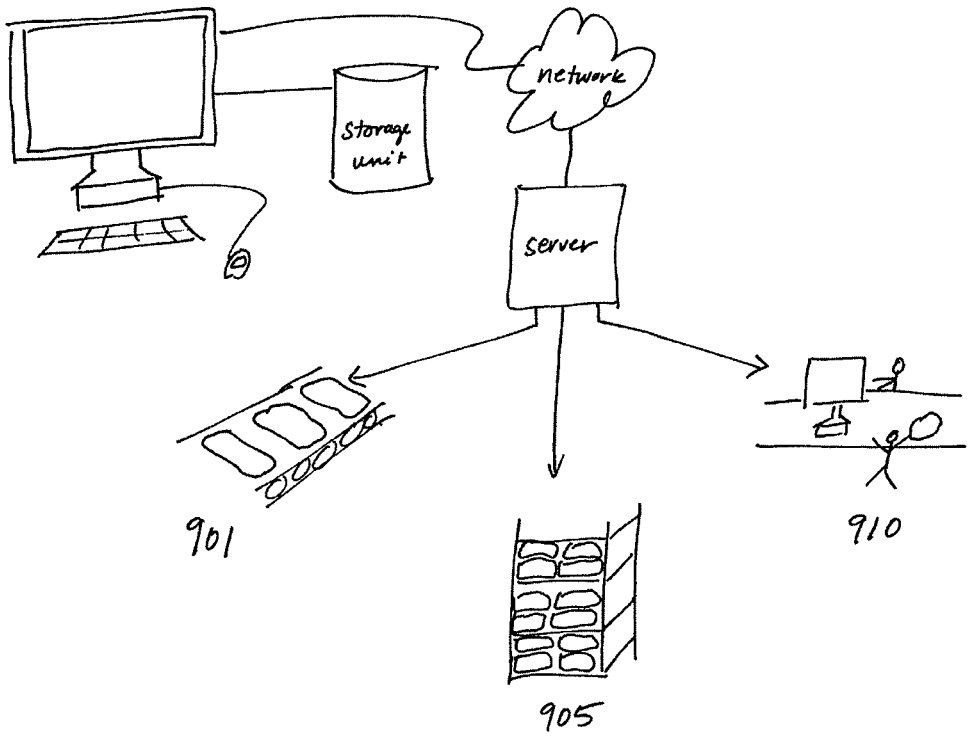
FIG. 10 illustrates a process for producing a custom-fitted pillow using the computerized pillow-fitting apparatus according to an illustrative embodiment.

In another illustrative embodiment, as shown in FIG. 10, once the pillow identifier is determined, the pillow identifier is provided to a manufacturer 901. The manufacturer 901 then constructs and assembles a pillow according to the specifications of Table 9 for a particular pillow identifier as illustrated in FIG. 10. The pillow is then provided to the customer. For example, the pillow is shipped to the customer or made available for the customer to pick up.

B. Retrieving a Pillow

In another illustrative embodiment, once the pillow identifier is determined, a sales clerk can retrieve the pillow corresponding to the pillow identifier from the storage area 905 of a store, for example, and provide the pillow to the customer as illustrated in FIG. 10.

C. Direct Delivery of a Pillow

In another illustrative embodiment, once the pillow identifier is determined, the user then locates the correct pillow according to the pillow identifier from a display in the store, takes the pillow to the cashier, and purchases the pillow 910, as illustrated in FIG. 10.

While the present invention has been particularly shown and described with reference to illustrative embodiments thereof, it will be understood by those or ordinary skill in the art that various changes in form and details may be made therein without departing from the spirit and scope of the present invention as defined by the following claims. The illustrative embodiments should be considered in descriptive sense only and not for purposes of limitation. Therefore, the scope of the invention is defined not by the detailed description above, but by the appended claims and their equivalents, and all differences within the scope will be construed as being included in the present invention.

What is claimed:

1. A computerized pillow-fitting method to recommend a pillow for use on a mattress that is separate from the pillow, comprising:

inputting, by a computer having a processor, a plurality of parameters corresponding to an individual's characteristics and a mattress firmness of the mattress;

determining, using the processor, a pillow identifier based on the plurality of parameters and the mattress firmness;

outputting from the computer the pillow identifier; and determining a pillow based on the pillow identifier.

2. The computerized pillow-fitting method of claim 1, wherein the determining the pillow identifier comprises:

determining values for each of the plurality of parameters;

summing the values of each of the plurality parameters; and multiplying the summation by at least one weighting factor to thereby calculate a pillow number.

3. The computerized pillow-fitting method of claim 1, wherein the plurality of parameters include a gender, an age, a height, a weight, a chest size, and a sleep position of the individual.

4. The computerized pillow-fitting method of claim 3, wherein the plurality of parameters further include a head size, a body posture, a neck size, and a body type of the individual.

5. The computerized pillow-fitting method of claim 1, wherein the determining the pillow identifier comprises determining values for each of the plurality of parameters; and wherein the computerized pillow-fitting method further comprises assigning each of the plurality of parameters a weighting factor based on overall importance of the parameter to providing a suitable pillow for the individual.

6. The computerized pillow-fitting method of claim 1, wherein the producing the pillow comprises manufacturing a pillow based on the pillow identifier.

7. The computerized pillow-fitting method of claim 1, wherein the producing the pillow comprises providing the individual with the pillow identifier and a pillow corresponding to the pillow identifier.

8. The computerized pillow-fitting method of claim 2, wherein the at least one weighting factor corresponds to a sleeping position parameter of the individual.

9. The computerized pillow-fitting method of claim 1, wherein the plurality of parameters include a parameter indicating whether the individual is a side sleeper, stomach sleeper, or back sleeper.

10. The computerized pillow-fitting method of claim 1, further comprising inputting, by the computer, a second plurality of parameters corresponding to the individual's preferences, wherein the second plurality of parameters include a preferred pillow fill, a preferred pillow density, and a preferred pillow cover of the individual.

11. The computerized pillow-fitting method of claim 1, wherein the plurality of parameters include: a height, a weight, an age, a sex, a posture, a body type, a chest size, a neck size, a head size, a preferred pillow firmness, and a sleeping position of the individual, and wherein the produced pillow has a fill weight and a material corresponding to the pillow identifier.

12. The computerized pillow-fitting method of claim 1, wherein the produced pillow is configured to support only a sub-region of the individual's body.

13. The computerized pillow-fitting method of claim 1, further comprising producing the determined pillow.

14. A computerized pillow-fitting method to recommend a pillow for use on a mattress that is separate from the pillow, comprising:

inputting, by a computer having a processor, a plurality of parameters corresponding to an individual's characteristics and a mattress firmness of the mattress;

determining, using the processor, a pillow identifier, based on the plurality of parameters and the mattress firmness, by comparing values for each of the plurality of parameters and the mattress firmness with a database entry, wherein the database entry includes pillow identifier information corresponding to the values for each of the plurality of parameters and the mattress firmness; and determining a pillow based on the pillow identifier.

15. A computerized pillow-fitting method according to claim 14, further comprising producing the determined pillow.

16. A computerized pillow-fitting apparatus for recommending a pillow for use on a mattress separate from the pillow, comprising:

a processor;

an input device configured to input a plurality of parameters corresponding to an individual's characteristics and a mattress firmness of the mattress;

a determination unit which uses the processor to determine, in response to the input of the plurality of parameters and the mattress firmness, a pillow identifier based on the plurality of parameters and the mattress firmness; and an output device configured to output the pillow identifier and configured to cause a pillow to be determined based on the pillow identifier.

17. The computerized pillow-fitting apparatus according to claim 16, wherein the output device is configured to produce the determined pillow.

18. The computerized pillow-fitting apparatus according to claim 16, wherein the plurality of parameters include: a height, a weight, an age, a sex, a posture, a body type, a chest size, a neck size, a head size, a preferred pillow firmness, and a sleeping position of the individual, and wherein the pillow to be produced has a fill weight and a material corresponding to the pillow identifier.

* * * * *